US010276323B2

(12) United States Patent
Schaefer

(10) Patent No.: US 10,276,323 B2
(45) Date of Patent: Apr. 30, 2019

(54) ACTUATING ELEMENT WITH CORONA ILLUMINATION

(71) Applicant: Continental Automotive GmbH, Hannover (DE)

(72) Inventor: Kay Schaefer, Dreieich (DE)

(73) Assignee: Continental Automotive GmbH, Hannover (DE)

( * ) Notice: Subject to any disclaimer, the term of this patent is extended or adjusted under 35 U.S.C. 154(b) by 0 days.

(21) Appl. No.: 15/517,962

(22) PCT Filed: Oct. 6, 2015

(86) PCT No.: PCT/EP2015/072977

§ 371 (c)(1),
(2) Date: Apr. 9, 2017

(87) PCT Pub. No.: WO2016/055435

PCT Pub. Date: Apr. 14, 2016

(65) Prior Publication Data

US 2017/0309418 A1 Oct. 26, 2017

(30) Foreign Application Priority Data

Oct. 8, 2014 (DE) ..... 10 2014 220 369

(51) Int. Cl.
*H01H 13/02* (2006.01)
*G05G 1/02* (2006.01)
(Continued)

(52) U.S. Cl.
CPC ..... *H01H 13/023* (2013.01); *G05G 1/02* (2013.01); *G05G 25/04* (2013.01); *H01H 13/83* (2013.01);
(Continued)

(58) Field of Classification Search
CPC ..... H01H 13/023; H01H 13/86; H01H 2219/0622; H01H 2223/004; G05G 1/02; G05G 25/04
(Continued)

(56) References Cited

U.S. PATENT DOCUMENTS 4,885,443 A 12/1989 Simcoe et al.
6,720,513 B2 * 4/2004 Fleissner ..... G05G 1/08 200/336

(Continued)

FOREIGN PATENT DOCUMENTS

DE 102007006592 B3 2/2008
DE 102013001876 A1 8/2014
JP 2006-12662 A 1/2006

OTHER PUBLICATIONS

DE 102007006592 (equivalent WO2008095596 machine translation), Ofenhitzer, Feb. 2008.*

(Continued)

*Primary Examiner* — Kyung S Lee

(57) ABSTRACT

The invention relates to an actuating element comprising corona illumination, having a handle (1), which can be moved linearly in a stationary housing (3) from a raised non-actuating position to a lowered actuating position by manually impacting on its horizontal actuating surface (2). Said actuating element further comprises a circumferential border (5) of the handle (1), which protrudes into the direction facing away from the actuating surface (2) and forms an annular gap (7) between the end thereof facing away from the actuating area (2) and a housing wall (6), which annular gap (7) leads radially outward from the housing interior (4) below the actuating area (2) to the housing exterior surrounding the handle in order to cause a linear movement of the handle (1). Said actuating element further comprises a light source (12) arranged in the housing
(Continued)

interior (4), the light whereof can be guided via an annular optical waveguide (11) corresponding to the border (5) of the handle (1) to the annular gap (7) and through same radially outward to the outside of the housing wall (6). Said actuating element further comprises electrical and/or electronic components arranged in the housing interior (4). The annular optical waveguide (11) has an annular wall which extends in the direction of the linear movement of the handle (1) and by means of which the housing interior (4) comprising the light source (12) and the electrical and/or electronic components is separated from the end area of the annular gap (7) facing the housing interior (4), wherein a channel (18) is formed between the annular wall and the housing (3) surrounding the annular wall, which channel (18) opens outward at its bottom end and wherein the optical waveguide (11) and the annular wall are configured in one piece (30).

10 Claims, 1 Drawing Sheet

(51) Int. Cl.

| | |
|---|---|
| ***G05G 25/04*** | (2006.01) |
| ***H01H 13/83*** | (2006.01) |
| ***H01H 13/86*** | (2006.01) |

(52) U.S. Cl.
CPC ..... *H01H 13/86* (2013.01); *H01H 2219/0622* (2013.01); *H01H 2223/004* (2013.01)

(58) Field of Classification Search
USPC ..... 200/313
See application file for complete search history.

(56) References Cited

U.S. PATENT DOCUMENTS

| | | | | |
|---|---|---|---|---|
| 6,878,887 | B2 * | 4/2005 | Amano | H01H 3/20 200/19.18 |
| 7,858,892 | B2 * | 12/2010 | Balsells | F16C 11/069 200/277 |
| 8,093,521 | B2 * | 1/2012 | Wang | H01C 10/14 200/314 |
| 2006/0179970 | A1 * | 8/2006 | Watanabe | G05G 1/105 74/553 |
| 2010/0220495 | A1 | 9/2010 | Truesdale et al. | |

OTHER PUBLICATIONS

International Search Report and Written Opinion dated Jan. 5, 2016 from corresponding International Patent Application No. PCT/EP2015/072977.
Search Report dated Jul. 31, 2015 in corresponding DE App. No. 102014220369.4.

* cited by examiner

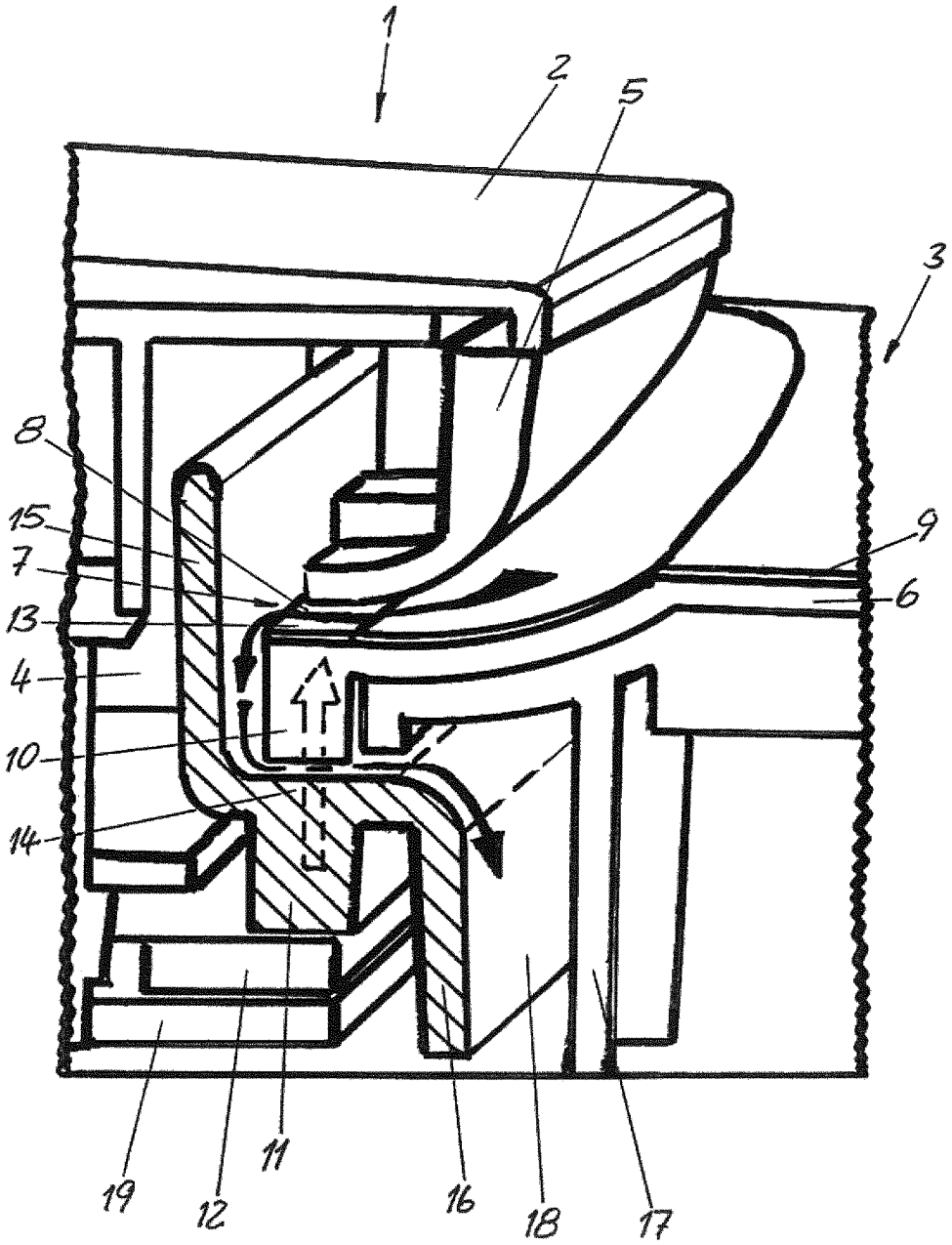
1
2
5
3
8
15
7
13
4
10
14
9
6
19
12
11
16
18
17

ACTUATING ELEMENT WITH CORONA ILLUMINATION

The invention relates to an actuating element with corona illumination, having a handle which can be moved linearly in a stationary housing from a raised non-actuating position to a lowered actuating position by manually acting on its horizontal actuating surface, having a circumferential edge of the handle, which edge projects in the direction facing away from the actuating surface and forms between its end facing away from the actuating surface and a housing wall an annular gap which leads radially outward to the housing exterior surrounding the handle in order to move the handle linearly from the housing interior underneath the actuating surface, having a light source which is arranged in the housing interior and whose light can be guided to the annular gap via a ring-like light guide corresponding to the edge of the handle and through said annular gap radially outward toward the outside of the housing wall, having electrical and/or electronic components arranged in the housing interior.

Actuating elements of this kind with corona illumination are applied, for example, as switches in vehicles. Moisture, liquids and also dirt can penetrate the housing interior through the annular gap and can damage electrical and/or electronic components and the light source which are present there. The object of the invention is therefore to provide an actuating element with corona illumination of the type specified at the beginning, in which the housing interior can easily be protected against the ingress of moisture, liquids and also dirt.

This object is achieved according to the invention in that the ring-like light guide has an annular wall which extends in the direction of linear movement of the handle and through which the housing interior having the light source and the electrical and/or electronic components is separated from the region of the end of the annular gap directed toward the housing interior, wherein an annular duct, which opens outward at its lower end, is formed between the annular wall and the housing surrounding the annular wall, and wherein light guide and annular wall are embodied in one piece.

As a result of this embodiment, the ingress of moisture, liquids and also dirt through the annular wall and into the housing interior via the functionally required annular gap is impeded and said moisture, liquids and also dirt are carried toward the outside along the annular gap.

As a result of the single-piece embodiment of the annular wall and light guide, just a single component with a double function is necessary both for the protection of the components arranged in the housing interior and for the inputting of light into the annular gap in order to generate corona illumination surrounding the handle. Therefore, only a small number of components are necessary, which also brings about a reduction in the expenditure on assembly and on logistics.

The light guide and annular wall are preferably composed of a glass-clear material such as, for example, plastic.

If the annular gap can be reduced from a relatively large width to a relatively small width as a result of the manual action on its horizontal actuating surface moving it from the raised non-actuating position into the lowered actuating position, the annular gap is, thus, also present in the actuating position, albeit with a relatively small width. The corona illumination therefore continues to be present in the actuating position, albeit with a relatively low intensity.

In order to bring about largely concentrated guiding of light from the light source to all the regions of the annular gap, the annular wall of the ring-like light guide can have a light input ring which has a ring-like light input surface which is directed toward the housing interior, and a ring-like light exit surface which is directed toward the end of the annular gap facing the housing interior.

In this context, the light input surface can face away from the actuating surface and/or the light exit surface can face the actuating surface.

In order to homogenize the corona illumination, the light exit surface can be a diffusely scattering exit surface.

In order to conduct away moisture, liquids and also dirt from the housing interior, the annular wall of the light guide can have a radially inner first wall region and a radially outer second wall region which are connected to one another via a radial horizontal wall region.

If, in this context, the light input ring is connected to the horizontal wall region, a wide ranging transmission of light takes place to the annular gap via the light exit surface, and only a relatively small degree of inputting of light into the annular wall occurs.

If the annular gap is embodied extending from the end facing the housing interior to its radially outer end, then despite a small width of the annular gap a wide corona illumination can be generated.

An increased intensity of the corona illumination is achieved by virtue of the fact that the radially outer end of the annular gap is directed to the actuating side of the handle.

In this context, the annular gap can be curved in a trough-like fashion.

The handle can have on its actuating surface a touchpad which requires only a small actuating travel between the non-actuating position and the actuating position and therefore requires a small width of the annular gap and therefore also a small overall height of the actuating element.

If the annular wall has a second light exit surface in its region facing the end of the annular gap which is directed toward the housing interior, then the portion of light input into this part of the annular wall can also be used for corona illumination.

BRIEF DESCRIPTION OF THE FIGURE

An exemplary embodiment of the invention is illustrated in the drawing and will be described in more detail below. The single FIGURE of the drawing shows an actuating element with corona illumination in section.

DETAILED DESCRIPTION

The illustrated actuating element with corona illumination has a handle 1 whose horizontal actuating surface 2 has a touchpad.

The handle 1 covers an opening of a housing 3 and as a result closes off the housing interior 4 in the upward direction.

At its edge region, the handle 1 has a radially circumferential edge 5 which projects in the direction facing away from the actuating surface 2, as far as close to a housing wall 6 of the housing 3, with the result that an annular gap 7 is formed between the edge 5 and the housing wall 6.

Through manual action on the actuating surface 2, the handle 1 is lowered by a certain amount, wherein the width of the annular gap 7 is reduced, but the annular gap 7 is not closed.

The end of the edge 5 facing away from the actuating surface 2 leads in an arcuate shape from an extent which is directed toward the housing interior 4 and approximately parallel to the actuating surface 2 into an extent which is approximately perpendicular with respect to the actuating surface 2 and forms the outer circumferential surface of the edge 5.

The housing wall 6 leads radially outward in a trough-like fashion from a radially inner region 8 which is spaced apart by the annular gap 7 from the edge 5, approximately parallel thereto, is likewise directed toward the housing interior 4, and has a larger radius than the outer surface of the edge 5, said outer wall 6 merging with an extent which is parallel to the actuating surface 2. As a result of the larger radius of the housing wall 6 than the radius of the outer surface of the edge 5, the annular gap 7 widens from its radially inner region to its radially outer region.

The housing wall 6 is composed of a transparent, light-guiding material and is covered, with the exception of the radially inner end region, by an at least largely opaque film 5 on its side facing an observer. In this radially inner end region which is free of the film 9, the housing wall 6 has a radially circumferential light-transmission ring 10.

A corresponding radially circumferential ring-like light guide 11 is arranged underneath and opposite the light-transmission ring 10, into which light guide 11 light can be input from a light source 12 arranged in the housing interior 4, said light being introduced from the light guide 11 into the light-transmission ring 10, which guides this light at its end region which is free of the film 9 and which forms a ring-like diffuse light exit surface 13, into the annular gap 7 and illuminates it.

The light guide 11 is embodied integrally with a light input ring 14 which is directed parallel to the actuating plate 2. The radially inner end of the light input ring 14 is adjoined by a first wall region 15 which extends toward the actuating surface 2, past the end of the annular gap 7 which is directed toward the housing interior 4. Since the first wall region 15 is composed, integrally with the light input ring 14, of a transparent, light-guiding material, a relatively small portion of the light input into the light input ring 14 also passes into the first wall region 15 and exits toward the annular gap 7 horizontally at the level of the inner mouth of said annular gap 7.

The radially outer end of the light input ring 14 is adjoined by a second wall region 16 which extends from the actuating surface 2, directed away as far as the rear side of the housing 3. A duct 18, which opens outward at its lower end, is formed between the second wall region 16 and a wall 17 of the housing 3 which is approximately parallel thereto.

The light source 12 as well as further electrical and electronic components (not illustrated) are arranged on a circuit board 19. Since liquids, moisture or dirt which pass from the outside to the inside through the annular gap 7 are carried away toward the outside by the first wall region 15 via the light input ring 14 and the second wall region 16, they cannot pass into the housing interior 4 and cause damage to the light source 12 and to the electrical and electronic components.

The invention claimed is:

1. An actuating element with corona illumination, having a handle (1) which can be moved linearly in a stationary housing (3) from a raised non-actuating position to a lowered actuating position by manually acting on its horizontal actuating surface (2), having a circumferential edge (5) of the handle (1), which edge (5) projects in the direction facing away from the actuating surface (2) and forms between its end facing away from the actuating surface (2) and a housing wall (6) an annular gap (7) which leads radially outward to the housing exterior surrounding the handle (1) in order to move the handle (1) linearly from the housing interior (4) underneath the actuating surface (2), having a light source (12) which is arranged in the housing interior (4) and whose light can be guided to the annular gap (7) via a ring-like light guide (11) corresponding to the edge (5) of the handle (1) and through said annular gap (7) radially outward toward the outside of the housing wall (6), having electrical and/or electronic components arranged in the housing interior (4), characterized in that the ring-like light guide (11) has an annular wall which extends in the direction of linear movement of the handle (1) and through which the housing interior (4) having the light source (12) and the electrical and/or electronic components is separated from the region of the end of the annular gap (7) directed toward the housing interior (4), wherein an annular duct (18), which opens outward at its lower end, is formed between the annular wall and the housing (3) surrounding the annular wall, and wherein light guide (11) and annular wall are embodied in one piece;

wherein the annular gap (7) can be reduced from a relatively large width to a relatively small width as a result of the manual action on its horizontal actuating surface (2), to move it from the raised non-actuating position into the lowered actuating position; and wherein the annular wall of the ring-like light guide (11) has a light input ring (14) which has a ring-like light input surface which is directed toward the housing interior (4), and a ring-like light exit surface (13) which is directed toward the end of the annular gap (7) facing the housing interior (4).

2. The actuating element as claimed in claim 1, characterized in that the light input surface faces away from the actuating surface and/or the light exit surface (13) faces the actuating surface (2).

3. The actuating element as claimed in claim 2, characterized in that the light exit surface (13) is a diffusely scattering exit surface.

4. The actuating element as claimed in one of the preceding claims, characterized in that the annular wall of the light guide (11) has a radially inner first wall region (15) and a radially outer second wall region (16) which are connected to one another via a radial horizontal wall region.

5. The actuating element as claimed in one of claims 2 to 4, characterized in that the light input ring (14) is connected to the horizontal wall region.

6. The actuating element as claimed in one of the preceding claims, characterized in that the annular gap (7) is formed extending from the end facing the housing interior (4) toward its radially outer end.

7. The actuating element as claimed in one of the preceding claims, characterized in that the radially outer end of the annular gap (7) is directed toward the actuating side of the handle (1).

8. The actuating element as claimed in one of claims 6 and 7, characterized in that the annular gap (7) is curved in a trough-like fashion.

9. The actuating element as claimed in one of the preceding claims, characterized in that the handle (1) has a touchpad on its actuating surface (2).

10. The actuating element as claimed in one of the preceding claims, characterized in that the annular wall has a second light exit surface in its region facing the end of the annular gap (1) which is directed toward the housing interior (4).

* * * * *